United States Patent [19]

Yearsley

[11] Patent Number: 4,922,590

[45] Date of Patent: May 8, 1990

[54] COMPACT CASKET ENCLOSURE SYSTEM AND METHOD

[76] Inventor: David Yearsley, 2208 Delaware Ave., Pittsburgh, Pa. 15218

[21] Appl. No.: 333,254

[22] Filed: Apr. 5, 1989

[51] Int. Cl.[5] ..... A61G 17/00

[52] U.S. Cl. ..... 27/19; 27/35

[58] Field of Search ..... 27/2–9, 27/17, 19, 35, 11

[56] References Cited

U.S. PATENT DOCUMENTS

| | | | |
|---|---|---|---|
| 520,098 | 5/1894 | Warner . | |
| 776,500 | 12/1904 | DeLong | 27/19 |
| 2,131,182 | 9/1938 | Kells | 27/35 |
| 2,508,319 | 5/1950 | Westenhaver | 27/35 |
| 2,815,130 | 12/1957 | Franks . | |
| 3,066,379 | 12/1962 | Meeks | 27/19 |
| 3,103,053 | 9/1963 | Hollis | 27/35 |
| 3,529,730 | 9/1970 | Thompson . | |
| 3,820,205 | 6/1974 | Shaw | 27/19 |
| 3,945,094 | 3/1976 | Dárán et al. | 27/11 |
| 4,074,811 | 2/1978 | Filak . | |
| 4,142,637 | 3/1979 | Kraiss . | |
| 4,154,031 | 5/1979 | Williamson, Jr. | 27/35 X |
| 4,669,157 | 6/1987 | Schwarten . | |
| 4,727,632 | 3/1988 | Yearsley | 27/35 |

FOREIGN PATENT DOCUMENTS

| | | | |
|---|---|---|---|
| 219008 | 11/1958 | Australia . | |
| 1113608 | 5/1968 | United Kingdom | 27/2 |

*Primary Examiner*—Richard E. Chilcot, Jr.
*Attorney, Agent, or Firm*—Clifford A. Poff

[57] ABSTRACT

To overcome problems concerning compact, inexpensive and long-term storage of entombment caskets in mausoleum crypts their is provided a extremely lightweight, yet durable enclosure for hermetically sealing caskets. The invention includes a foldable casket tray which receives a casket. A durable cover of wrapping material is placed over the casket and is attached and hermetically sealed to the tray. The cover is formed with a pressure relief valve for periodic self-ventilation of gases produced by decomposition of the casket and its contents enclosed within the hermetically sealed enclosure. When in folded condition, the tray serves as a compact shipping and storage container for the cover, a tray liner, and materials for attaching and hermetically sealing the cover to the tray. By virtue of the hermetic seal and extreme light weight of the enclosure, the enclosure is particularly adaptable for use in more compact, lightweight and inexpensive casket storage rack systems than are presently required for above ground mausoleum crypts.

19 Claims, 3 Drawing Sheets

COMPACT CASKET ENCLOSURE SYSTEM AND METHOD

BACKGROUND OF THE INVENTION

1. Field of the Invention

This invention relates to the art of mortuary science, and in particular, it is concerned with a novel article and the method of its use in connection with enclosing and protecting entombment caskets for above-ground burial in mausoleum crypts of all kinds, including chapel crypts, garden crypts, and chapel garden crypts, hereinafter referred to generally as mausoleum crypts.

2. Description of the Prior Art

It is well known, in mortuary science, to provide, for enclosing a casket, a burial vault for below ground interments which is made of two pieces of "synthetic plastic resinous material" which are fitted together to provide an air-tight seal. Such an article, together with a practice for its use, is disclosed, for example, in any of the U.S. Pat. Nos. 3,208,188; 3,208,186; and 4,154,031. The prior art contains a burial vault made of fiberglass, as shown in U.S. Pat. No. 3,172,183; and it contains a burial vault made of polyethylene or other molded plastic material, as in the above-mentioned U.S. Pat. No. 4,154,031.

In the prior art as exemplified by the above-mentioned patents, the burial vaults have invariably been of a bulky two-piece construction comprising a rigid base and a rigid dome-shaped lid, and these articles have been intended for use in underground burial, replacing massive concrete structures which were at one time used in order to provide the necessary load-bearing characteristics which are important in connection with such burial.

In the prior art, there has been, prior to the present invention, less of an appreciated need for providing a further air-tight enclosure around the casket in the case of having the casket protected in a mausoleum crypt. Experience with the maintenance of mausoleum crypts has revealed, however, that there may be, in the practice of this method of the long-term protection of remains, as much of a need, if not more of a need, for the use of an additional air-tight sealing structure around the casket, regardless of whether the casket itself is of a sealing or a non-sealing type. Persons charged with the maintenance of the mausoleums and crypts are well aware of the necessity of providing ventilation means for the crypts, and of spending money on various means which are used to mask or suppress odors or to control insects and other pests.

The prior art, with the exception of my own prior U.S. Pat. No. 4,727,632, has not provided a self-ventilating, air-tight casket enclosure structure for use in an above-ground mausoleum crypts which eliminates or greatly reduces the costs associated with odor suppression and insect or other pest control. Furthermore, construction costs for typical mausoleum crypts have been prohibitively high owing to the fact that relatively great amounts of concrete have been required for the construction of each crypt chamber for receiving and supporting the caskets. Also, the concrete of the crypt chambers was subject to deterioration from contact with corrosive chemical compounds produced by the decomposition of the casket and the remains therein. Unless strict measures were followed to ensure complete and long-term sealing of the caskets within suitable casket containers before inserting the containers into the crypt chambers, such corrosive compounds would quickly act to degrade the concrete of the surrounding crypt chambers. My prior U.S. Pat. No. 4,727,632, however, provided a significant step in overcoming the above-mentioned shortcomings of the prior art.

The present invention provides a still greater improvement over the prior art. By being extremely light in weight (i.e., less than 9 pounds in weight as compared with 96 pounds for the casket enclosure of my prior patent, for example) and simple in construction, the present invention provides a minimum of construction requirements for strength, where such is necessary, as well as a compact structure which may be easily and inexpensively shipped and stored. Thus, not only are the casket enclosure costs reduced, but so too are the costs of constructing and maintaining the crypt chambers which receive and support the casket enclosures of the present invention. And, mausoleum space can be more efficiently used since a greater number of caskets may be stored in each mausoleum since the need for extensive concrete frameworks for supporting the caskets may be advantageously replaced by more compact rack structures to serve the same purpose. Preferably, such rack structures would be formed of prefabricated, lightweight and corrosion-resistant elements which can be subsequently erected in a crypt or mausoleum to provide a compact support rack system for supporting the enclosed caskets of the present invention.

It is therefore an object of the invention to provide a two-piece casket enclosure for mausoleum crypts, which is of simple construction and extremely light in weight.

It is further object to provide a casket enclosure which is hermetically sealed and capable of venting decomposition gases from the enclosure when necessary.

It is a further object to provide a casket enclosure which is easily, compactly and inexpensively shipped and stored.

It is a further object to provide a casket enclosure which is adaptable to crypt chambers of simpler and less expensive construction than is presently employed.

Still other objects and advantages will become apparent when one considers the attached drawings and the description of the invention presented hereinbelow.

SUMMARY OF THE INVENTION

To overcome problems concerning the storage of entombment caskets in mausoleum crypts, there is provided an extremely lightweight, hermetically-sealed, ventilating casket enclosure. The enclosure is of two-piece construction characterized by a tray for receiving the casket and a cover of rugged, chemically-resistant, and gas and water impervious wrapping material which is placed over the casket and attached to the tray. The cover is provided with a means for automatically ventilating gases from within the casket enclosure for releasing gases produced by the decomposition of the casket and the remains therein. The tray is foldable between an open casket-receiving position and a closed, compact, shipping and storage position. In the closed position, the tray serves as a container for compact shipping and storage of the cover. By virtue of its extremely light weight, the casket enclosure of the present invention is particularly adaptable to crypt chambers of simpler and less expensive construction than is presently employed.

DESCRIPTION OF THE PREFERRED EMBODIMENT

Figure 1:
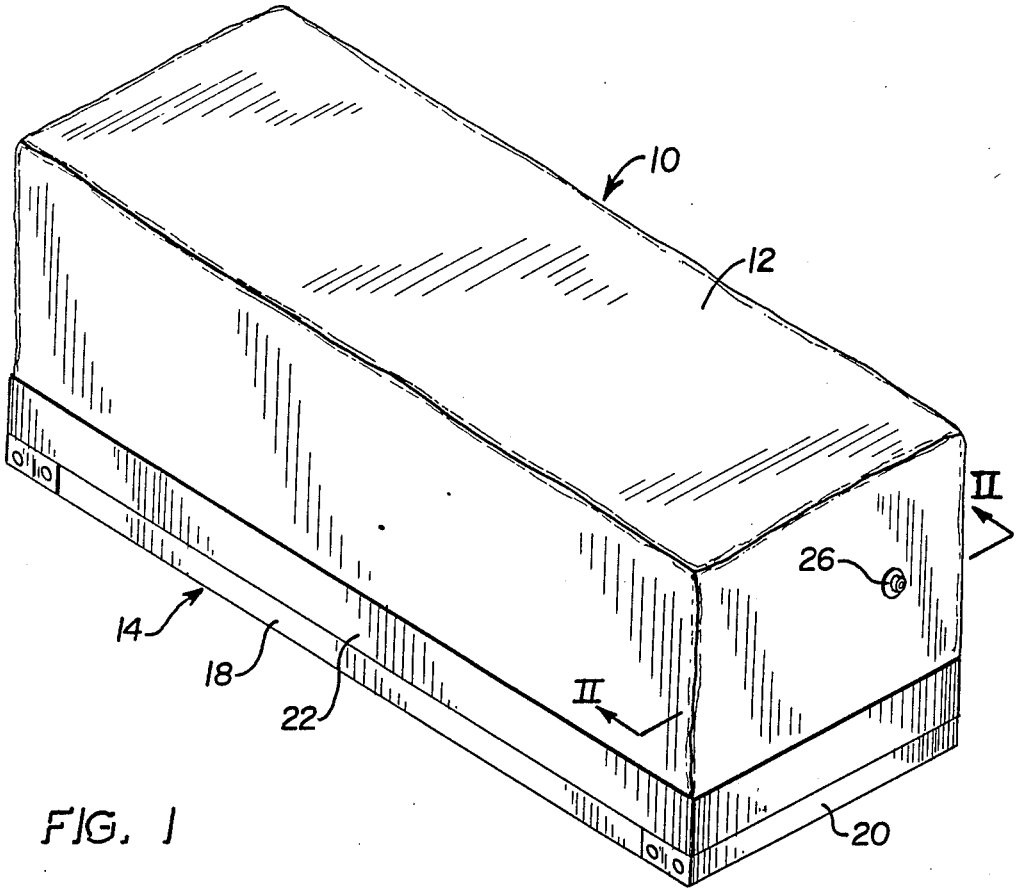
FIG. 1 is a perspective view of the casket enclosure of the present invention in assembled condition.

There is depicted in FIG. 1 a perspective view, in assembled condition, of the novel entombment casket enclosure 10 of the present invention. The casket enclosure 10 includes a casket cover 12 and a tray 14 which are attachable to one another to enclose a casket C therein.

The cover 12 is a foldable and flexible one-piece wrapping material preferably formed from a DuPont Corporation product commercially known as "Tyvek". "Tyvek" is Dupont's trademark for a family of tough, durable sheet products that are stronger than paper and more versatile than fabrics. Made from high-density spun bonded polyethylene fibers, "Tyvek" offers a balance of physical characteristics that combines the most advantageous properties of paper, film, and cloth. "Tyvek" is strong, lightweight, smooth, opaque and resistant to water, chemicals, abrasion, puncturing and aging.

The tray 14 has a generally rectangular floor portion 16, and upstanding sidewalls 18 and endwalls 20. Preferably, as will be described hereinbefore, the tray 14 is formed of chemically-hardened yet flexible plastic material having sufficient rigidity to form both a sturdy self-sustaining base for receiving a casket when the tray is unfolded to an open position and a sturdy self-sustaining shipping and storage container when the tray is folded to a closed position. Adjacent edges of the upstanding sidewalls 18 and endwalls 20 are preferably secured to one another by ultrasonic welding.

A particular and novel advantage of the tray 14 is that it is foldable between a compact, closed, shipping and storage position and on open, casket-receiving position.

For this purpose, the tray 14 is divided into two tray half-portions by two parallel spaced-apart fold lines 15 which are created in the proximate mid-portion of the tray 14 when the tray is folded to the closed shipping and storage position. In such position, the distance between the fold lines 15 corresponds approximately to the height of the sidewalls 18 and the endwalls 20 of tray 14.

Figure 2:
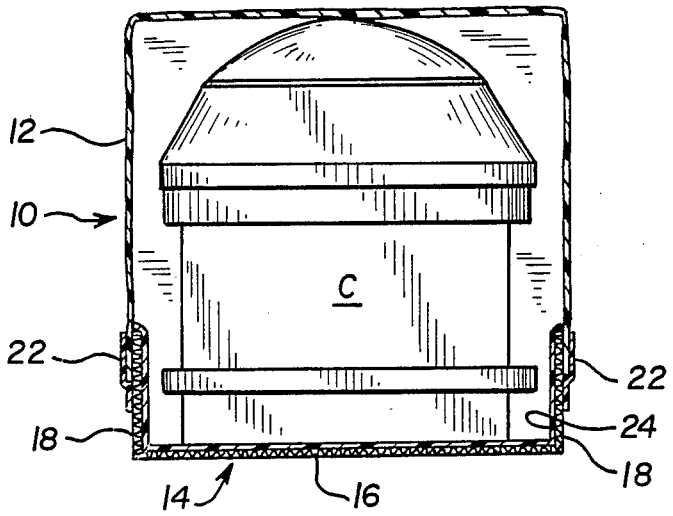
FIG. 2 is a vertical cross-section of the casket enclosure taken along line II—II of FIG. 1.
Figure 3:
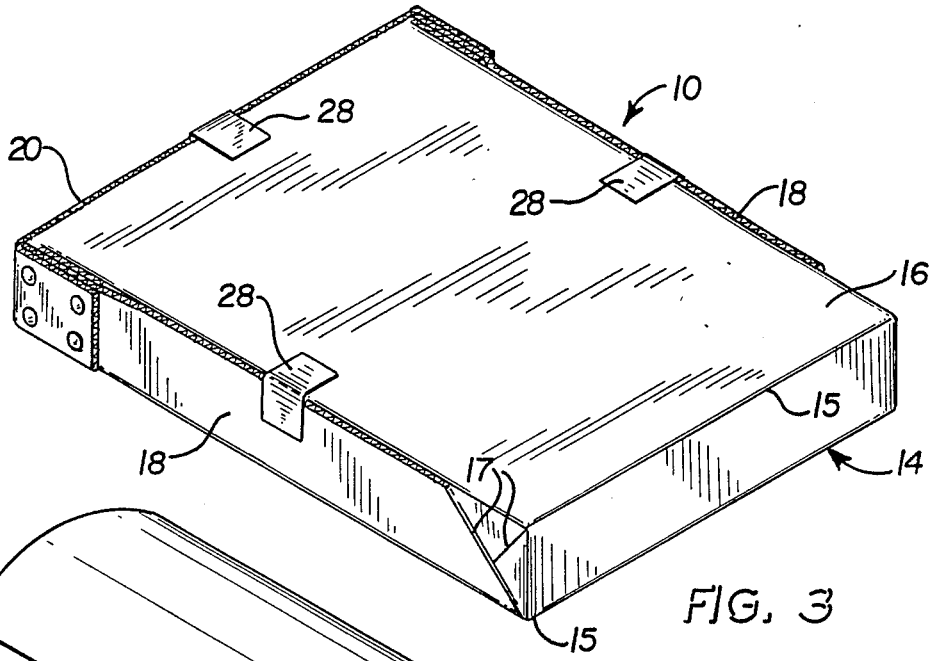
FIG. 3 is a perspective view of the casket enclosure in a folded shipping and storage position.
Figure 4:
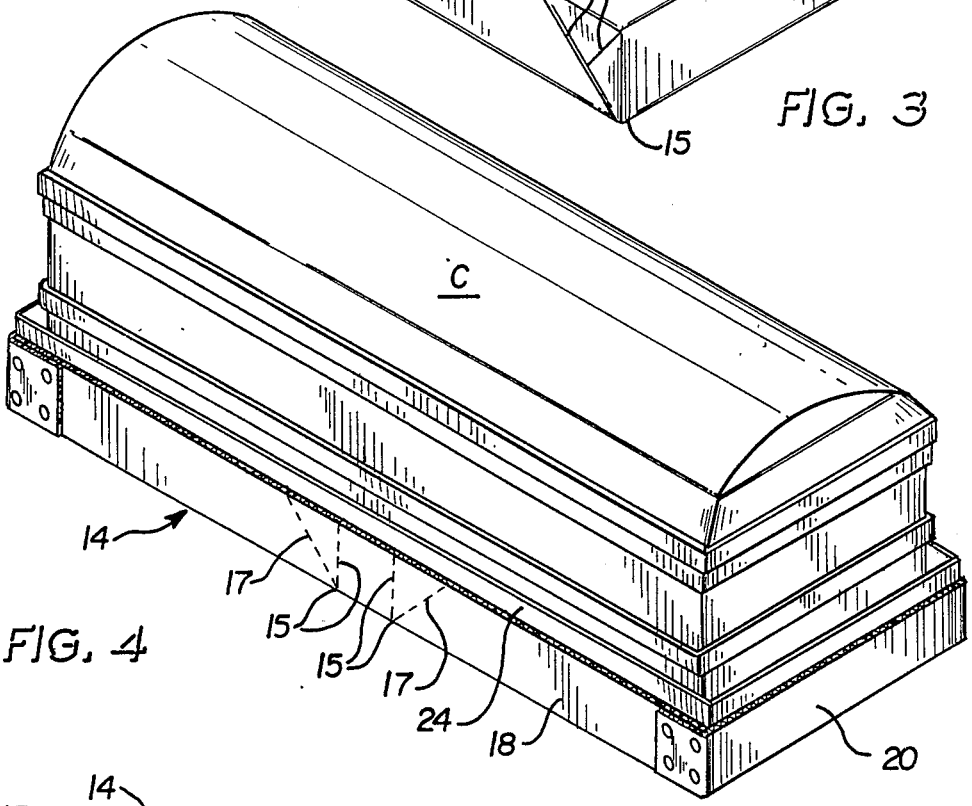
FIG. 4 is a perspective view of the casket enclosure in an unfolded casket receiving position with the cover thereof removed for purposes of illustration.

As shown in FIG. 3, when tray 14 is folded to the closed position, each of the sidewalls 18 inwardly folds upon itself to form inwardly directed creases 17. These creases 17 are shown in full lines in the closed or folded position of FIG. 3, and, for purposes of illustration, in dashed lines in the unfolded or open position of FIG. 4. Also shown in FIG. 4 are creases 15' which originate at fold lines 15 and extend upwardly along each of the sidewalls 18. As illustrated in FIG. 3, the creases 15' and 17 as well as fold lines 15 are all clearly formed when the tray is folded from the open to the closed position. Traces of the creases 15' and 17 as well as traces of the fold lines 15 remain when the tray is unfolded to the open position as shown in FIG. 4. When in the unfolded open position, the tray 14 acts as a sturdy self-sustaining base for receiving an entombment casket C. Preferably, a tray liner 24 is placed in tray 14 before the casket C is placed therein. The purpose of the tray liner 24 is to protect the tray 14 from damage when the casket C is placed therein. The tray liner 24, like cover 12, is also desirably formed of "Tyvek" material. As best seen in FIG. 2, once placed atop tray liner 24 in tray 114, casket C is then covered with cover 12. Cover 12 is of sufficient size to completely envelop at least the upper portions of sidewalls 18 and endwalls 20 of tray 14 and all portions of casket C which protrude above the upper edges of sidewalls 18 and endwalls 20 of tray 14.

When the cover 12 is in proper position, a means for attaching and hermetically sealing the cover 12 to the tray 14 is applied to the outer surfaces of the upstanding sidewalls 18 and endwalls 20 of tray 14 and the lower portions of cover 12. The means for attaching and hermetically sealing the cover 12 to the tray 14 is preferably a length of durable adhesive tape 22 which is approximately three inches wide so that it will provide a sufficient band of coverage over the lower portions of cover 12 and the exposed portions of sidewalls 18 and endwalls 20 of tray 14. The adhesive tape 22 is of sufficient length to extend completely about the outer peripheries of the cover 12 and the sidewalls 18 and endwalls 20 to completely attach and hermetically seal the cover 12 to tray 14. When properly applied, the adhesive tape 22 provides a complete hermetic seal of the enclosure 10 around casket C.

A unique advantage of the construction of the casket enclosure 10 of the present invention is that, if necessary, the enclosure 10 may be easily disassembled and reassembled. Thus, the enclosure 10 of the present invention is not only advantageously used for long-term entombments but is also particularly well suited for disinterment/reinterment or transfer cases. Still further, due to the complete hermetic seal provided by the present invention, the casket enclosure 10 is also particularly adaptable for use in cases where the deceased within the casket has died of a highly contagious disease and the spread of such disease to others must be completely and assuredly prevented.

The cover 12 is also provided with a pressure relief means in the form of a one-way check valve 26. The check valve 26 is formed integrally with cover 12. The function of check valve 26 is to periodically vent or release gases produced by the decomposition of the casket and the contents thereof which are contained within the enclosure 10. The check valve 26 operates automatically to relieve gas pressure within the enclosure 10 before such pressure reaches levels sufficient to destroy the hermetic seal between cover 12 and tray 14. Desirably, this valve has an exterior port which is connectable to a ventilation pipe which communicates via suitable tubing with the exterior of the mausoleum of garden crypt.

The enclosure 10 of the present invention is also uniquely conducive to efficient and economical shipping and storage. The tray 14 is of chemically-hardened yet flexible plastic material.

Figure 5:
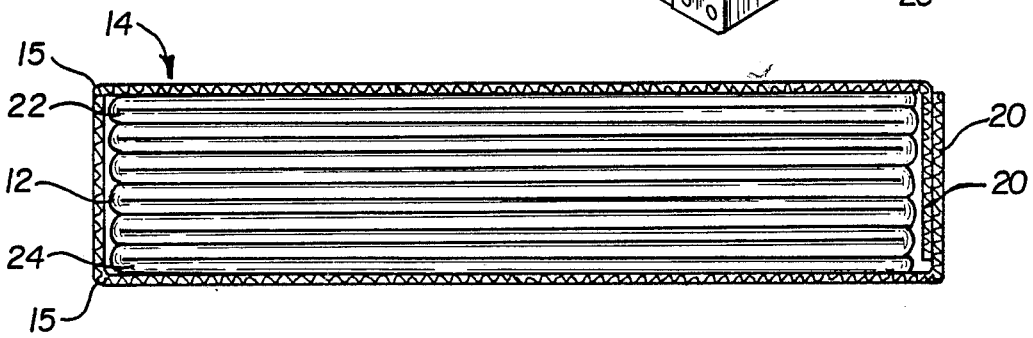
FIG. 5 is a side view of the casket enclosure in folded shipping and storage position with a side wall removed for purposes of illustration.

The tray 14 is preferably formed of two spaced-apart facing sheets which are bonded to a corrugated web therebetween. As stated hereinabove, the tray 14 is foldable between a compact, closed, shipping and storage position and an open, casket-receiving position. As seen most clearly in FIG. 5, the tray 14, when folded to the closed position, serves as a sturdy self-sustaining and shipping storage container for the adhesive tape 22, the cover 12, and tray liner 24, all in compact folded condition within folded tray 14. The tray 14 is normally retained in the closed shipping and storage position by conventional adhesive tape 28 as shown in FIG. 3. The entire package of tray 14, cover 12, tray liner 24, and adhesive tape 22, weighs less than nine pounds. To provide a comparison with prior casket enclosures, the casket enclosure disclosed in my prior U.S. Pat. No. 4,727,623, for example, weighs approximately 96 pounds—or more than 10 times the weight of the casket enclosure 10 of the present invention. The savings in shipping cost provided by the present invention, as one can readily see, are quite significant. Also, due to the compact size of casket enclosure 10 in folded position, a much greater number of such enclosures may be stored in inventory than was previously possible with the rigid, bulky casket enclosures of the prior art.

Those skilled in the art will appreciate the potential usefulness of the invention in enabling the design and construction of a novel kind of mausoleum crypt, one in which, instead of it being necessary to provide, for each crypt enclosure, concrete in relatively great amounts, there is provided a structure which is lighter in weight, more compact, and simpler in construction than those presently used. Such a structure becomes possible because the casket enclosures 10 of the present invention by themselves serve as individual crypt chambers thus avoiding the need for surrounding concrete crypt chambers.

Figure 6:
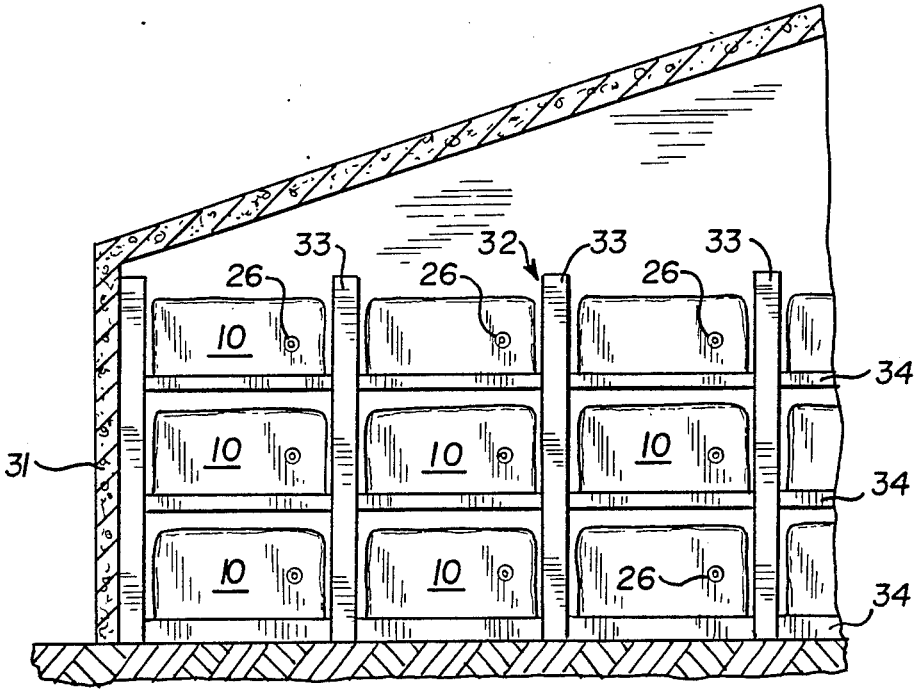
FIG. 6 is an elevational view of an above ground mausoleum, containing a prefabricated support rack for supporting a plurality of casket enclosures.
Figure 7:
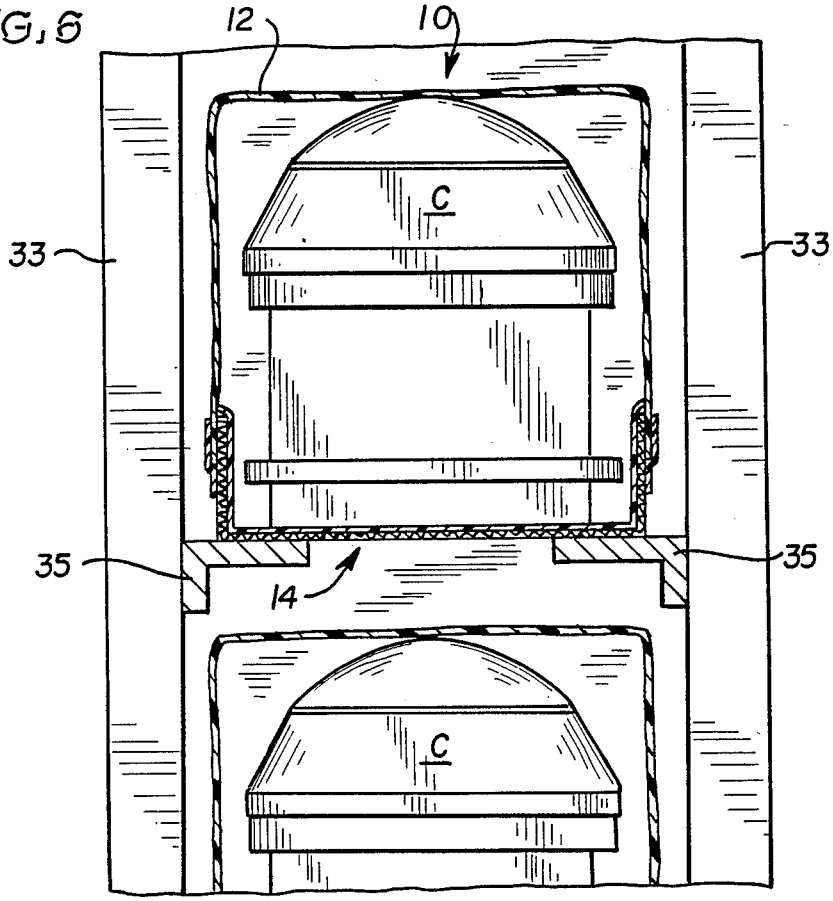
FIG. 7 is an enlarged view in partial section of the support rack of FIG. 6 detailing the points of contact between the casket enclosure and the support rack.

FIGS. 6 and 7 illustrate a preferred embodiment of a novel mausoleum crypt structure which may be usable with the casket enclosures 10 of the present invention. As seen in FIG. 6, a plurality of sealed casket enclosures 10 are stored in an above ground mausoleum building 31. Compact storage racks 32 are suitably arranged in the building 31 to receive and provide long term support sites for the sealed enclosures 10. The racks 32 are preferably formed of prefabricated, lightweight, corrosionresistant elements which are assembled at the mausoleum site to form a complete rack support system for the sealed enclosures 10. Racks 32 typically will have vertical columns 33 and horizontal beams 34 interconnecting columns 33. Also, as illustrated in FIG. 7, horizontal slider elements in the form of angle members 35 may be used in combination with horizontal beams 34 to ease the sliding of the enclosures 10 into the racks 32. Columns 33, horizontal beams 34, and angle members 35 are typically fastened together by conventional fastening means such as screws, bolts, rivets, and the like.

By eliminating the need for traditional concrete crypt chambers, the compact support rack system as depicted in FIGS. 6 an 7 provides substantial construction cost reductions, allows more freedom of the architectural design of the mausoleum, and permits more caskets to be stored per mausoleum. The support racks 32 are lightweight and virtually maintenance-free, they are inexpensively shipped to the mausoleum, and are simply constructed and installed at the mausoleum site.

The present invention thus provides a sealed crypt enclosure which is compact, extremely light in weight, easily assembled, inexpensively shipped and stored, and adaptable for use with novel lightweight, prefabricated storage rack systems in mausoleums. Such storage rack systems thus avoid the use of extensive concrete structures for each crypt chamber since the casket enclosure of the present invention, in and of itself, serves as an individual crypt chamber.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An hermetically sealable enclosure for an entombment casket comprising:

tray means formed of chemically hardened flexible plastic material for receiving said casket; said tray means having a substantially rectangular floor means, and sidewalls and endwalls upwardly extending from side and end portions, respectively, of said rectangular floor means; said tray means being foldable between a closed shipping and storage position and an open casket-receiving position; said tray means having sufficient rigidity to act as a sturdy self-sustaining base for receiving said casket when in said open position and as a sturdy self-sustaining shipping and storage container when in said closed position;

means separate from said tray means for covering said casket when said casket is received in said tray means;

said casket covering means comprising foldable wrapping material of sufficient dimensions to envelop at least upper portions of said sidewalls and said endwalls and all portions of said casket protruding above said sidewalls and said endwalls when said casket is received in said tray means; and means for hermetically sealing said casket covering means with said tray means to thereby provide an hermetically sealed enclosure for long-term storage of said casket.

2. The enclosure of claim 1, further comprising means for lining said tray means.

3. The enclosure of claim 2, wherein said casket covering means and said means for lining said tray means are formed of the same material.

4. The enclosure of claim 3, wherein the material forming said casket covering means and said means for lining said tray means is a material which is impervious to air and water and resistant to chemicals, puncturing and aging.

5. The enclosure of claim 1, wherein said sidewalls and said endwalls of said tray means are of a height which is substantially less than the height of the casket received therewithin.

6. The enclosure of claim 1, wherein said means for hermetically sealing said casket covering means with said tray means comprise adhesive tape means.

7. The enclosure of claim 6, wherein said adhesive tape means attaches lowermost portions of said casket covering means to said sidewalls and said endwalls of said tray means.

8. The enclosure of claim 1, wherein said casket covering means further includes pressure relief means for releasing gases produced by the decomposition of the casket and the contents thereof which are contained within said enclosure, whereby said pressure relief means acts automatically to relieve gas pressure within the enclosure before such pressure reaches levels sufficient to destroy the hermetic seal between the casket covering means and the tray means.

9. The enclosure of claim 8, wherein the pressure relief means comprises a one-way check valve.

10. The enclosure of claim 1, wherein, in the closed shipping and storage position, the tray means has spaced apart fold lines substantially centrally located therein; the spaced apart fold lines substantially dividing the tray means into two half-portions, whereby the one of the half-portions is folded above the other half-portion.

11. The enclosure of claim 1, wherein, in the closed shipping and storage position, the tray means contains therein the means for hermetically sealing said casket covering means to said tray means and the wrapping material of the casket covering means in folded condition.

12. The enclosure of claim 11, wherein, in the closed shipping and storage position, the tray means further contains therein, in folded condition, a means for lining the tray means.

13. The enclosure of claim 1, wherein adjacent edges of the sidewalls and endwalls are ultrasonically welded to one another.

14. The method for providing an hermetically sealed enclosure for storage of an entombment casket comprising the steps of:

(a) unfolding a tray means formed of chemically hardened flexible plastic material from a closed shipping and storage position to an open casket receiving position, said tray means having sufficient rigidity to act as a sturdy self-sustaining base for receiving said casket when in said open position and as a sturdy self-sustaining shipping and storage container when in said closed position;

(b) placing said casket in said tray means;

(c) covering those portions of said casket which protrude from said tray means with a separate foldable wrapping material;

(d) hermetically sealing said wrapping material to said tray means; and (e) venting the space enclosed by said enclosure.

15. The method as defined in claim 14 further comprising lining said tray means with a lining material after said tray means is unfolded to said open casket-receiving position and before said casket is placed in said tray means.

16. The method as defined in claim 15, wherein, in said closed shipping and storage position, said tray means provides a receptacle for: said wrapping material, said lining material, and means for hermetically sealing said wrapping material to said tray means.

17. The method as defined in claim 14, where step (e) is performed by pressure relief means formed integral with said wrapping material, whereby said pressure relief means acts to release gases within the enclosure produced by the decomposition of the casket and the contents thereof which are contained within said enclosure, before such gases reach pressure levels sufficient to destroy the hermetic seal between the wrapping material and the tray means.

18. The method as defined in claim 14, further comprising the step of supporting said casket enclosure in a prefabricated lightweight rack means in an above ground mausoleum building.

19. a storage system for compact storage of at least one enclosed entombment casket, said system comprising:

tray means formed of chemically hardened flexible plastic material for receiving said casket; said tray means having a substantially rectangular floor means, and sidewalls and endwalls upwardly extending from side and end portions, respectively, of said rectangular floor means; said tray means being foldable between a closed shipping and storage position and an open casket-receiving position; said tray means having sufficient rigidity to act as a sturdy self-sustaining base for receiving said casket when in said open position and as a sturdy self-sustaining shipping and storage container when in said closed position;

means separate from said tray means for covering said casket when said casket is received in said tray means;

said casket covering means comprising foldable wrapping material of sufficient dimensions to envelop at least upper portions of said sidewalls and said endwalls and all portions of said casket protruding above said sidewalls and said endwalls when said casket is received in said tray means;

means for hermetically sealing said casket covering means with said tray means to thereby provide an hermetically sealed enclosure for long-term storage of said casket; and a prefabricated lightweight support rack means for supporting and storing said at least one casket.

* * * * *